US005577481A

United States Patent [19]

Wahba

[11] Patent Number: 5,577,481

[45] Date of Patent: Nov. 26, 1996

[54] FUEL INJECTOR

[75] Inventor: Brent J. Wahba, Honeoye Falls, N.Y.

[73] Assignee: General Motors Corporation, Detroit, Mich.

[21] Appl. No.: 578,312

[22] Filed: Dec. 26, 1995

[51] Int. Cl.[6] ..... F02M 69/04; F02M 55/02

[52] U.S. Cl. ..... 123/470; 123/472

[58] Field of Search ..... 123/470, 472, 123/445, 305; 239/585.1, 585.3, 900

[56] References Cited

U.S. PATENT DOCUMENTS

| | | | |
|---|---|---|---|
| Re. 33,841 | 3/1992 | Rush et al. | 239/543 |
| 4,393,994 | 7/1983 | Rieck | 239/585 |
| 4,423,842 | 1/1984 | Palma | 239/585 |
| 4,423,843 | 1/1984 | Palma | 239/585 |
| 4,621,772 | 11/1986 | Blythe et al. | 239/585 |
| 4,646,974 | 3/1987 | Sofianek et al. | 239/585 |
| 4,699,323 | 10/1987 | Rush et al. | 239/585 |
| 5,044,562 | 9/1991 | Rogers et al. | 239/543 |
| 5,054,456 | 10/1991 | Rush, II et al. | 123/470 |
| 5,109,823 | 5/1992 | Yokoyama et al. | 123/472 |
| 5,201,806 | 4/1993 | Wood | 123/472 |
| 5,501,194 | 3/1996 | Kanehara et al. | 123/472 |

*Primary Examiner*—Thomas N. Moulis
*Attorney, Agent, or Firm*—Karl F. Barr, Jr.

[57] ABSTRACT

An electromagnetic fuel injector is disclosed having an orificed fuel injector plate, mounted downstream of a solenoid actuated valve and an associated main orifice passage opened and closed by the valve, to receive fuel when the valve is moved to an open position from an associated valve seat for controlling and directing fuel flow from the injector. The director plate is provided with a plurality of injection orifices to direct fuel streams towards the valve head of an engine intake poppet valve while avoiding targeting the valve stem to thereby reduce the incidence of fuel reflection from the valve stem and associated intake surface wetting.

4 Claims, 3 Drawing Sheets

FUEL INJECTOR

TECHNICAL FIELD

The invention relates to a fuel injection system for an internal combustion engine.

BACKGROUND

Electromagnetic fuel injectors used in internal combustion engines are capable of effectively controlling the discharge of a precise metered quantity of fuel per unit time to the engine. Proper fuel preparation results in a homogeneous fuel/air mixture with a resulting reduction of fuel deposition on intake manifold surfaces. Such fuel deposition can lead to fuel wetting of these surfaces resulting in less than optimum emission, fuel economy and driveability performance. Any object disposed in the path of the fuel spray will cause spray reflection resulting in the surface wetting phenomena. An identified contributor to fuel spray reflection is the intersection of the spray cone, exiting the fuel injector, with the engine intake valve stem.

SUMMARY

Accordingly it is an object of the present invention to provide a fuel injection system for use in the intake of an internal combustion engine which produces highly atomized and precisely targeted fuel delivery at the back of the intake valve while avoiding fuel impact with the valve stem. The fuel injection system includes an electromagnetic fuel injector for delivery of metered quantities of fuel to the intake port of the engine. The fuel injector has an injector body having an inlet for receiving fuel and an outlet about which extends a valve seat. A solenoid actuated valve member cooperates with the valve seat to regulate the flow of fuel through the seat and out of the injector. Downstream of the valve and seat is a fuel director having a series of fuel directing orifices which are configured to direct the flow of fuel exiting the injector in a crescent or semi-circular pattern.

The creation of the semicircular fuel spray pattern by the fuel director at the outlet of the injector body allows the fuel to be targeted, with respect to the engine intake valve and valve stem, in such a manner that the fuel can directly impact the back of the valve while avoiding the valve stem and the inherent fuel reflectivity and resulting intake port wall wetting that may result.

These and other features, objects and advantages of the invention will be more apparent by reference to the following detailed description and to the drawings.

DESCRIPTION OF THE PREFERRED EMBODIMENT

Figure 1:
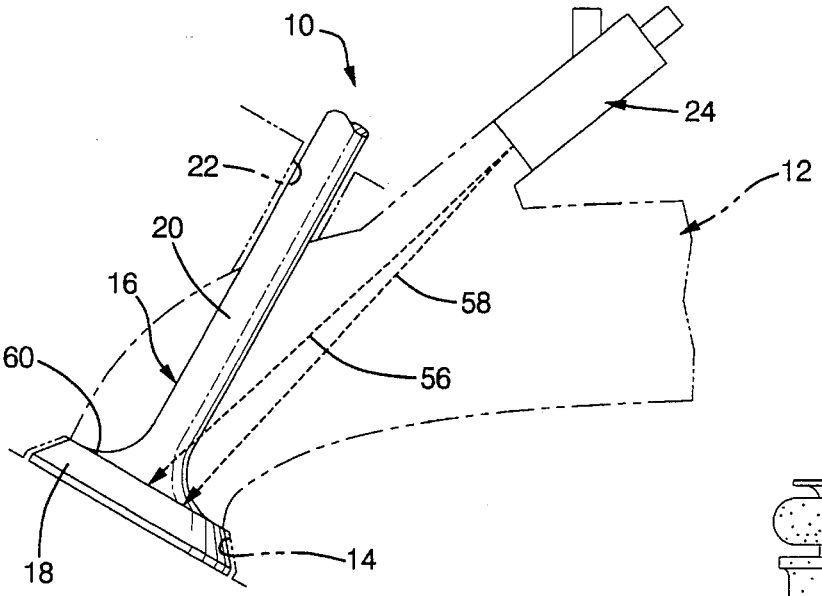
FIG. 1 is a partial schematic view of an intake port for an internal combustion engine.

Referring to FIG. 1 there is illustrated a portion of an intake system, designated generally as 10, useful for conducting an intake charge to the combustion chamber of an internal combustion engine, not shown. The intake system includes an intake port, or conduit 12 which extends from a circular intake valve seat 14, which opens to the engine combustion chamber, to an upstream inlet, not shown. The intake port 12 is supplied with air for combustion from the upstream inlet and an intake popper valve 16 is disposed for reciprocal movement with respect to the intake valve seat 14 to regulate the flow of air into the combustion chamber of the engine.

The intake valve 16 includes a circular valve head 18 that sealingly engages the valve seat 14 and is supported by a valve stem 20 carried in a valve guide 22 mounted within a wall of the intake port 12. A valve actuating mechanism (not shown) is provided to actuate the intake popper valve 16 in timed relation to the operation of the engine to thereby open and close, respectively, to gas flow.

Disposed within the intake port 12 upstream of the intake valve 16 is an electromagnetic fuel injector, designated generally as 24, for metering a predetermined quantity of fuel to the inlet port. Atomized fuel which is injected into the port 12 by the injector 24 is mixed with inlet air passing through the port and the air/fuel mixture is admitted to the combustion chamber by the inlet valve 16.

Figure 2:
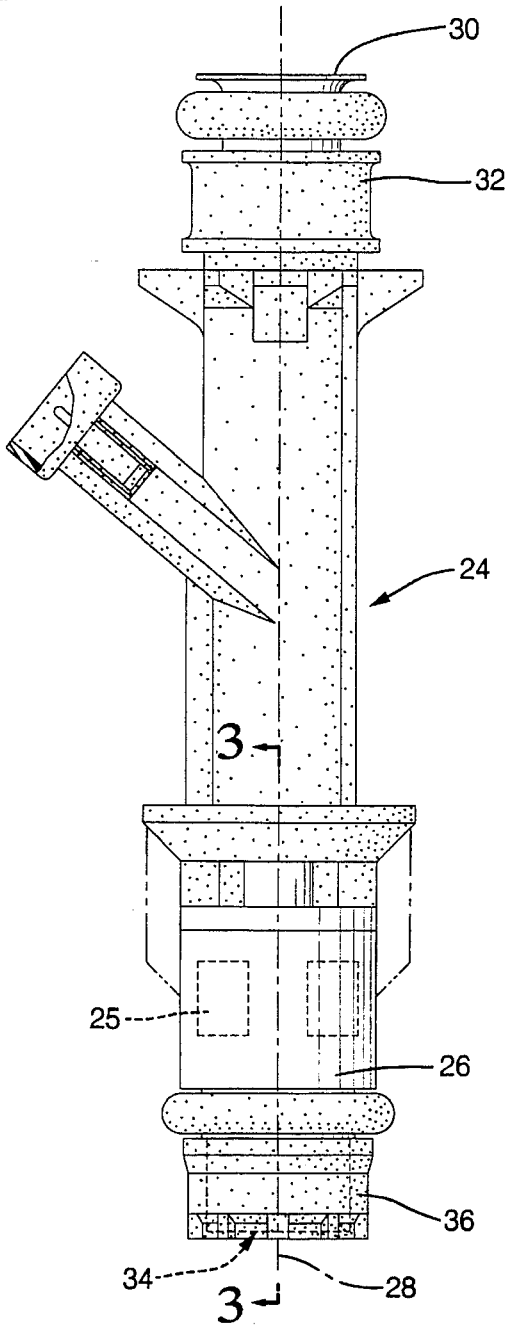
FIG. 2 is a side view of an electromagnetic fuel injector for an internal combustion engine.
Figure 3:
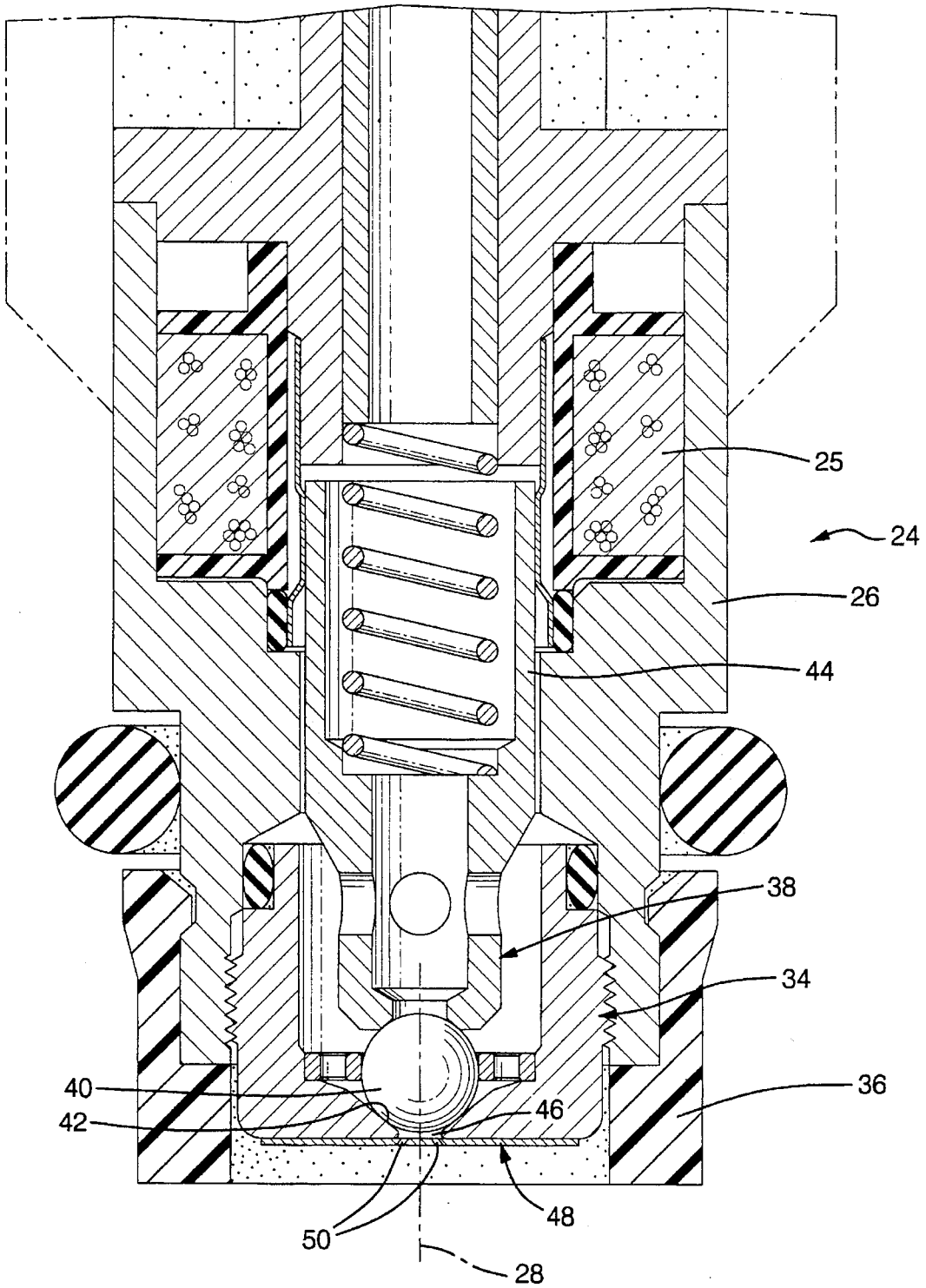
FIG. 3 is a partial, sectional view of the fuel injector of FIG. 2 taken along line 3—3 of FIG. 2.

The fuel injector 24, FIGS. 2 and 3, has a solenoid assembly 25 disposed within a generally cylindrical and stepped diameter shell 26 defined by a longitudinal axis 28 and having a fuel inlet 30 at a first end 32 and a fuel injection nozzle assembly 34 at a second end 36. The fuel inlet receives fuel from a pressurized source (not shown). Operatively mounted for linear movement along the injector axis 28 is a reciprocally movable valve assembly 38 having at its lower end, as viewed in the Figures, a core ball 40 which is adapted to be moved from a seated and fuel sealing engagement position with a cooperating valve seat 42 to define a flow passage through the nozzle assembly 34. The valve assembly 38 is controlled in its movement by the electromagnetic force of the periodically energizable solenoid 25 which operates on armature 44 of the valve assembly 38. When the core ball 40 is lifted from its seat by actuation of the solenoid 25, fuel flows from the fuel injector inlet 30 through the shell 26 to an area closely adjacent the valve seat 42 and ball 40 from where it discharges through the opening 46 in valve seat 42 and onto flow director plate 48.

Figure 4:
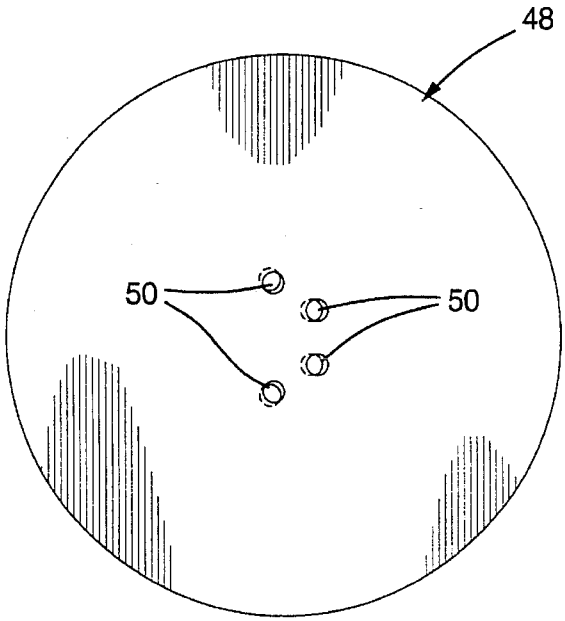
FIG. 4 is a plan view of a fuel director plate of the fuel injector of FIG. 2.
Figure 5:
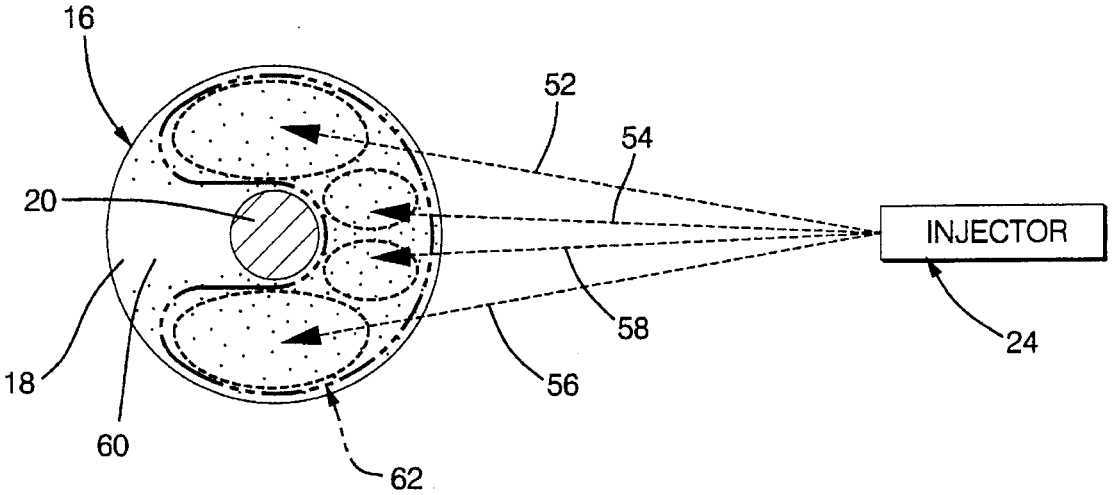
FIG. 5 is a schematic view of an engine intake poppet valve and associated fuel injector illustrating fuel spray patterns.

The flow director plate 48, FIGS. 3 and 4, is supported in a fixed position at the lower end of the nozzle assembly 34 and comprises a flat plate member extending normal to the injector axis 28. The fuel director plate 48 includes a series of fuel injection orifices 50 formed, for instance, by electron discharge machining, or other suitable methods such as punching and laser drilling, at set predetermined angles with respect to the plane of the director plate 48. The orifices 50 are configured and disposed relative to the injector longitudinal axis 28, and to one another, such that fuel flowing onto the director plate 48 from the valve opening 46 will be distributed to each of the injection orifices 50 through which it exits the injector 24 in multiple, discrete fuel sprays 52, 54, 56, 58. The director plate orifices 50 are engineered to cooperate with one another to provide the targeted fuel sprays 52, 54, 56, 58 which impact the back 60 of the intake poppet valve head 18 at a predetermined distance from the injector outlet to define a substantially multi-lobed are of fuel spray 62 which can best be described as a crescent or semi-circular fuel spray pattern of the type shown in FIG. 5. The crescent or semi-circular spray pattern 62 is configured to target the valve head 18 of the intake poppet valve 16 while minimizing fuel impact with the valve stem 20. As a result, accuracy of fuel delivery is maximized while reflected spray, caused by the intersection of injected fuel with the valve stem is minimized. The reduction in the quantity of reflected spray significantly aids in reducing the fuel collection on the surfaces of the intake port.

The electromagnetic fuel injector 24 of the present invention provides a mechanism for improving the targeting and delivery of fuel to the back of the intake valve of an internal combustion engine combustion chamber while minimizing the incidence of reflected fuel spray and subsequent intake port wall wetting. Such an improvement is provided through the direction of fuel into a crescent or semi-circular spray pattern to thereby avoid intersection of the fuel with the intake valve stem and resulting fuel spray reflection and intake port wall wetting. Reduction of wall wetting may improve engine emissions, fuel economy and driveability.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiments described were chosen to provide an illustration of the principles of the invention and of its practical application to thereby enable one skilled in the art to utilize the invention in various embodiments and with various modifications as are suited to the use contemplated. Therefore, the foregoing description is to be considered exemplary, rather than limiting, and the true scope of the invention is that described in the following claims.

I claim:

1. A director plate for an electromagnetic fuel injector for discharging fuel into the intake system of an internal combustion engine, said director plate having a plurality of injection orifices at predetermined locations on said director plate and extending through said director plate, each of said injection orifices being inclined at a predetermined angle to said central axis so that said injector orifices will direct streams of fuel towards a target in said engine intake system whereby said streams of fuel will impinge upon said target in a crescent pattern.

2. A director plate for an electromagnetic fuel injector, as defined in claim 1, said target comprising an engine intake poppet valve having a circular valve head supported by a valve stem wherein streams of fuel impinge upon said valve head in said crescent pattern while avoiding impingement upon said valve stem.

3. A fuel injector for directing discrete spray streams of fuel from an outlet to an intake valve disposed in an intake system of an internal combustion engine, said injector having a valve element with a core ball and a valve seat, defining a fuel flow passage therebetween, an actuator for moving said core ball to a fixed lift position off of said valve seat to allow fuel to flow through said injector, and a director plate defining a longitudinal axis and having a plurality of injection orifices at predetermined locations on said director plate and extending through said director plate, each of said injection orifices being inclined at a predetermined angle to said longitudinal axis so that said injector orifices will direct streams of fuel towards a target in said engine intake system whereby said streams of fuel will impinge upon said target in a crescent pattern.

4. A fuel injector, as defined in claim 3, said target comprising an engine intake poppet valve having a circular valve head supported by a valve stem wherein streams of fuel impinge upon said valve head in said crescent pattern while avoiding impingement upon said valve stem.

* * * * *